United States Patent [19]

Harris et al.

[11] Patent Number: 5,065,596

[45] **Date of Patent: * Nov. 19, 1991**

[54] DUAL LOUVERED SIDE AIR DISCHARGE OPENINGS FOR ROOM AIR CONDITIONER

[75] Inventors: James E. Harris, Hermitage; Leonard T. Farfaglia, deceased, late of Brentwood, by Mary M. Farfaglia, legal representative; Steven D. Wetherholt, Nashville all of Tenn.

[73] Assignee: Whirlpool Corporation, Benton Harbon, Mich.

[ * ] Notice: The portion of the term of this patent subsequent to Nov. 19, 2008 has been disclaimed.

[21] Appl. No.: 522,199

[22] Filed: May 11, 1990

[51] Int. Cl.[5] ..... F25D 23/12

[52] U.S. Cl. ..... 62/262; 62/426; 62/407; 98/94.2

[58] Field of Search ..... 62/262, 426, 407, 412, 62/419; 98/94.2

[56] References Cited

U.S. PATENT DOCUMENTS

| | | | |
|---|---|---|---|
| 2,373,496 | 4/1945 | Paiste, Jr. | 98/94.1 |
| 2,373,497 | 4/1945 | Paiste, Jr. | 98/94.1 |
| 2,604,763 | 7/1952 | Lipman | 62/262 |
| 2,735,351 | 2/1956 | Abrahamsen | 98/40.2 |
| 2,737,788 | 3/1956 | Buttner | 62/262 |
| 2,952,997 | 9/1960 | Mullin | 62/427 |
| 3,128,689 | 4/1964 | Binsfeld | 62/262 |
| 3,158,005 | 11/1964 | Jungemann | 62/262 |
| 3,257,931 | 6/1966 | Lupton | 98/40.2 |
| 3,257,931 | 9/1966 | Wegman | 98/94.2 |
| 3,306,182 | 2/1967 | Schwartz | 98/94.2 |
| 3,320,871 | 5/1967 | Wegman | 98/94.2 |
| 3,472,149 | 10/1969 | Harrison | 98/94.2 |
| 3,500,738 | 3/1970 | Wenig | 98/94.2 |
| 3,509,613 | 5/1970 | Koenig | 29/157 |
| 3,685,427 | 8/1972 | Loyd | 98/94.2 |
| 3,699,873 | 10/1972 | Irvin | 62/262 |
| 3,713,376 | 1/1973 | Ring | 98/110 |
| 3,756,039 | 9/1973 | Riello | 62/262 |
| 3,783,637 | 1/1974 | Woods | 62/262 |
| 3,805,542 | 4/1974 | Hosoda et al. . | |
| 4,492,094 | 1/1985 | Katayama | 62/262 |
| 4,633,770 | 1/1987 | Taylor et al. | 98/40.17 |
| 4,729,293 | 3/1988 | Tsunoda et al. | 98/40.24 |
| 4,777,870 | 10/1988 | Bolton et al. | 98/40.24 |

*Primary Examiner*—Albert J. Makay
*Assistant Examiner*—John Sollecito
*Attorney, Agent, or Firm*—Hill, Van Santen, Steadman & Simpson

[57] ABSTRACT

A room air conditioner in which separate lateral air outlets are provided for returning chilled air to the room. An air outlet device having horizontal and vertical louvers is provided at the air outlets and both sets of louvers can be pivoted such that the user can independently select a direction for the exiting air streams from a wide range of vertical and horizontal angles. The air outlet devices are preferably modular units which are attached to the air conditioner by means of releasable vertically oriented pivots.

19 Claims, 3 Drawing Sheets

DUAL LOUVERED SIDE AIR DISCHARGE OPENINGS FOR ROOM AIR CONDITIONER

BACKGROUND OF THE INVENTION

The invention is directed to a room air conditioner and more particularly to a room air conditioner having dual, louvered air discharge openings. Room air conditioners generally have an air inlet and an air outlet at a front side of the air conditioner which faces the interior of the room when the air conditioner is positioned in a window opening or in a through-the-wall sleeve. Usually warm air is drawn in through a central portion of the front panel to pass through a filter and through the evaporator coil to be cooled and then is directed by a blower or fan to an outlet or outlets, also in the front panel. The outlet may be a single opening positioned either along a top or bottom edge of the front panel or may be a single opening positioned at one side or the other of the front panel. Occasionally the air from the blower is directed into a manifold type box or plenum chamber and from that chamber it is allowed to exit through the front of the air conditioner through more than one opening. For example in U.S. Pat. No. 3,472,149, assigned to the assignee of the present invention, air is drawn into the air conditioner unit through a lower front grill portion and is redelivered to the room through a grill portion which extends along the top edge of the air conditioner.

In U.S. Pat. No. 2,737,788, air is drawn in from a front lower grill opening, through a filter and the air is pressurized by a fan mounted in a manifold chamber or plenum from which air is permitted to exit through two spaced grills. In U.S. Pat. No. 4,492,094 air is drawn in through a front grill, is pressurized by a fan and exits through a grill 30 located at a bottom edge of the front panel. FIGS. 1 and 2 of that patent illustrate prior art constructions of top and side return of cooled air to the room.

The use of a manifold plenum chamber or similar structure requires an extra space in the air conditioner thereby reducing the compactness of the air conditioner and adding to bulkiness. Also such a structure requires extra parts and weight, thus increasing the costs and complexity of manufacturing. Oftentimes, particularly when the air outlet is positioned on a single side of the air conditioner, the air is drawn into the air conditioner evaporator coil in an off-center fashion thereby reducing the efficiency of the air conditioner.

Air outlet openings are occasionally provided with directional controls which may be in the form of louvered members. U.S. Pat. No. 3,713,376 discloses the use of a plurality of louvered discharge members which are mountable into and removable from an air conditioner and which pivot about a vertical axis to provide a range of directional air flows. The individual louvers, however, are stationary within the members.

U.S Pat. No. 3,257,931 discloses a louvered air outlet assembly wherein the louvers are pivotable about both a horizontal and vertical axis. The louvers are also powered such that they will continuously rotate during operation so that the chilled air will be directed in a sweep pattern horizontally and vertically.

SUMMARY OF THE INVENTION

It is an object of the present invention to provide an air conditioner that has a dual air flow exit in which each of the air outlets is separately directable.

It is a further object to provide a room air conditioner outlet that is directable in both a horizontal and vertical sense.

It is a further object of the invention to provide a room air conditioner that has a dual air flow exit from the front lateral sides of the air conditioner in which the air flow from the two exits is substantially equal.

It is a further object of the invention to provide a room air conditioner outlet device that is modular in format and can be quickly and easily assembled to and removed from the air conditioner unit.

These and other objects are accomplished by providing a room air conditioner that has a centrally located evaporator coil and directly behind the evaporator coil is a blower wheel which is configured and arranged to draw air in through the center of the wheel and cause the air to exit radially and tangentially as the wheel rotates. The wheel is located in a housing forming a volute with two separate openings that are configured and arranged so that approximately 50% of the air is caused to exit from each of the openings. The volute openings each communicate with a separate transition duct space which leads directly to the front panel of the air conditioner. Separate opening controls in the form of modular box-like units are provided at each front panel opening so that the user can select the desired flow path for the exiting air.

The modular box-like units have compressible pins at a top and bottom end which snap into snap mounts in the air conditioner which permit the modular units to pivot about a vertical axis. The units contain both vertical and horizontal louvers and the horizontal louvers are each pivotable about a horizontal axis such that the air direction passing through the units can be directed through both a vertical and horizontal angular range. A separate modular unit is provided at each lateral side of the front of the air conditioner and each unit is independently postionable such that a user may selects a desired air flow pattern from a wide range of available patterns. By placing the air outlet units at each lateral side of the air conditioner and permitting the units to pivot about a vertical axis permits a wider horizontal range of air flow patterns than is available with conventional room air conditioners.

DETAILED DESCRIPTION OF THE PREFERRED EMBODIMENT

Figure 1:
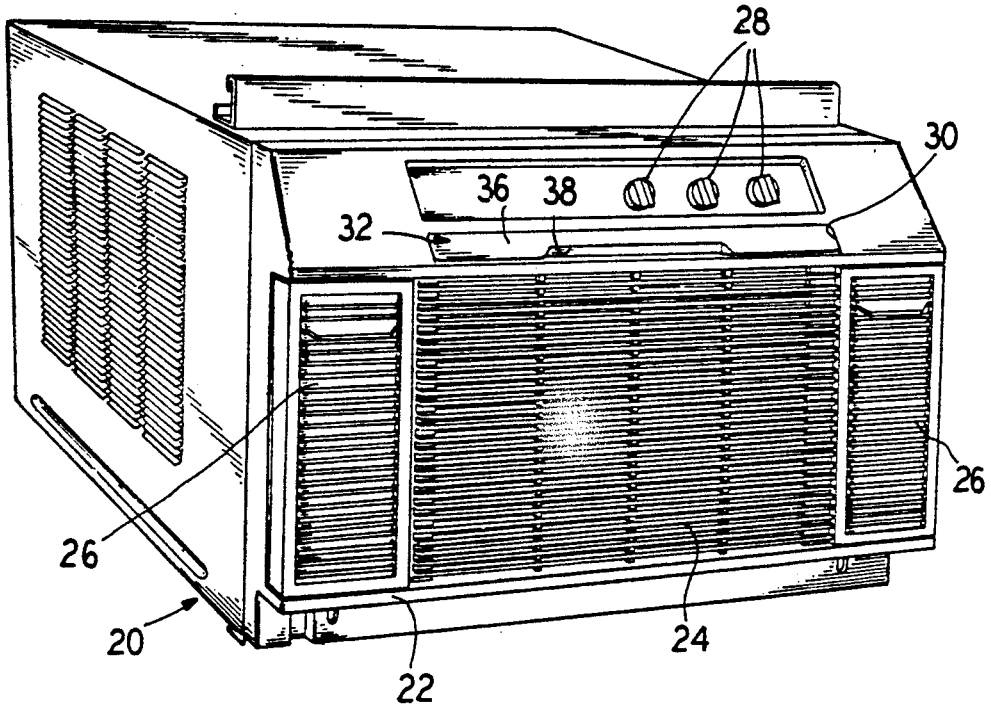
FIG. 1 is a perspective view of a room air conditioner embodying the principles of the present invention.
Figure 2:
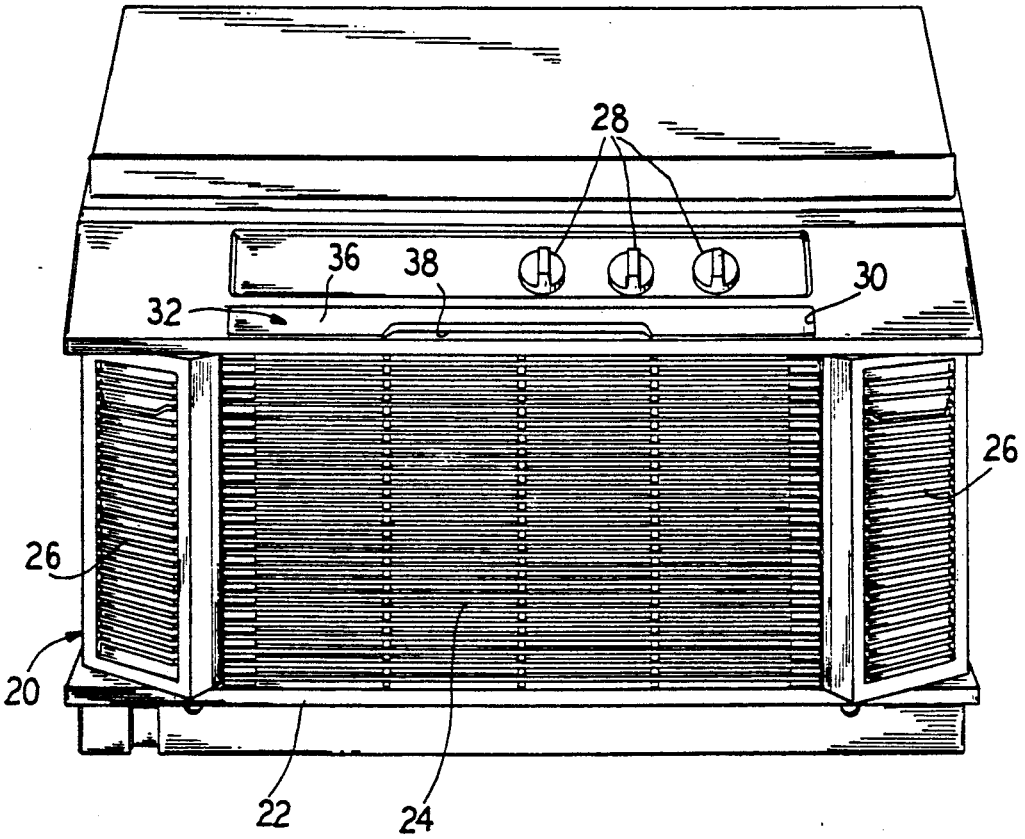
FIG. 2 is a front/top perspective view of the air conditioner of FIG. 1 illustrating directional range of the air discharge outlets.

FIG. 1 illustrates an air conditioner generally at 20 which embodies the principles of the present invention. The air conditioner has a front panel 22 which faces the interior of a room to be cooled when the air conditioner unit is placed in an open window or in a through-the-wall sleeve. A central portion 24 of the panel constitutes an air inlet grill through which air flows into a portion of the air conditioning unit. The air is returned to the room through a pair of laterally spaced outlet modular units 26. The modular units 26 are independently controllable by the user and contain louvers that are pivotable about both a vertical axis and horizontal axis giving the user a wide range of air flow configurations as described in greater detail below.

A plurality of controls 28 are provided on an angled control panel area above the inlet grill. Positioned above the inlet grill 24 and below the controls is a slot 30 within which is received an air filter element 32. The air filter 32 is comprised of a semi-rigid frame including a top bar 36 having a recessed finger grip area 38. The placement of the filter 32 causes the filter element to be readily accessible from the exterior of the air conditioner cabinet and does not require removal of any portions of the air conditioner cabinet in order for the filter to be removed to determine whether it needs to be cleaned. Replacement of the filter element is just as easy, that is by sliding the filter frame into the slot 30. A particular filter arrangement is described in greater detail in copending application Ser. No. 522172 entitled "Dual Side Air Housing for Room Air Conditioner" which disclosure is incorporated herein by reference.

Figure 3:
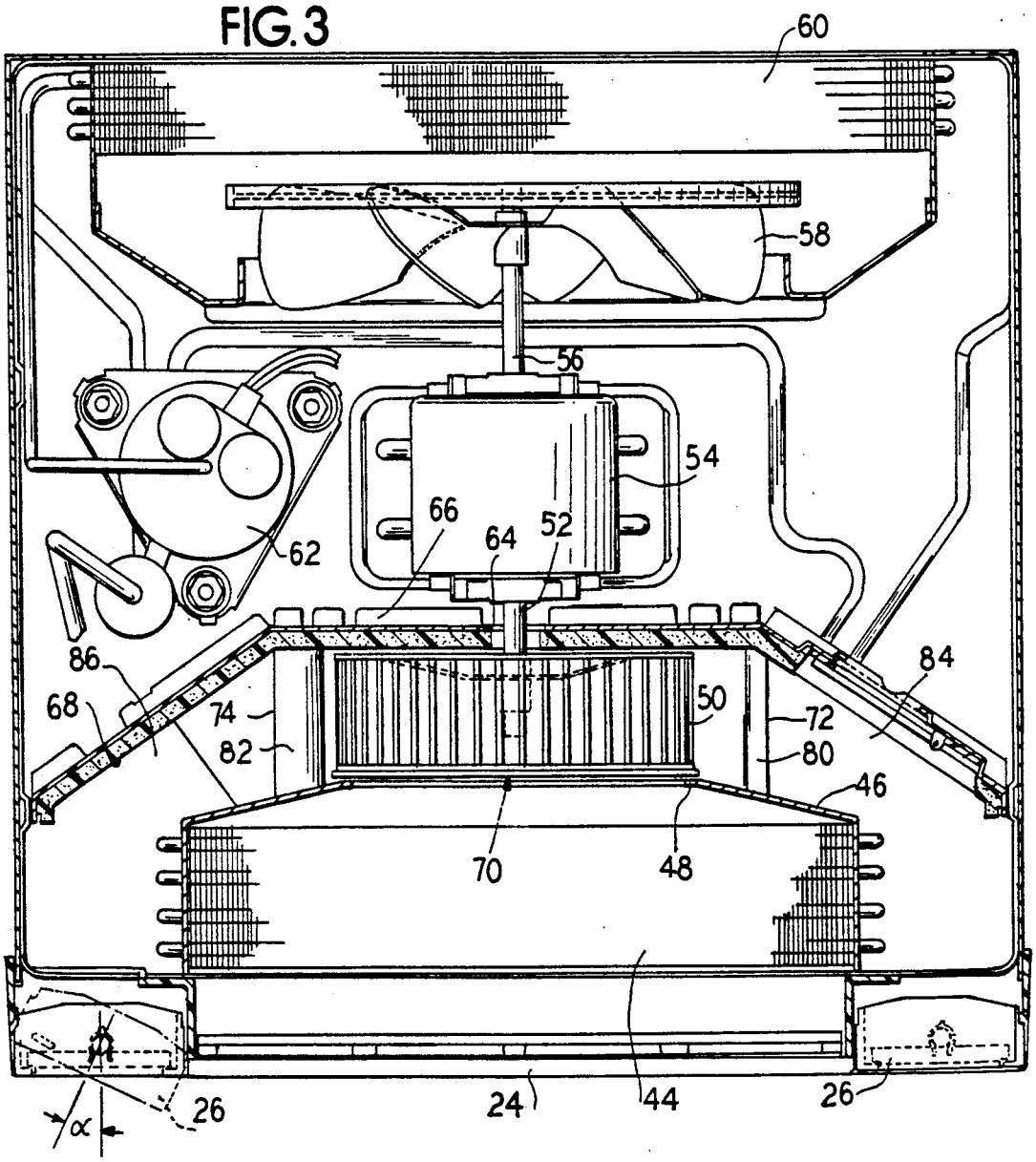
FIG. 3 is a top sectional view of the air conditioner of FIG. 1.
Figure 5:
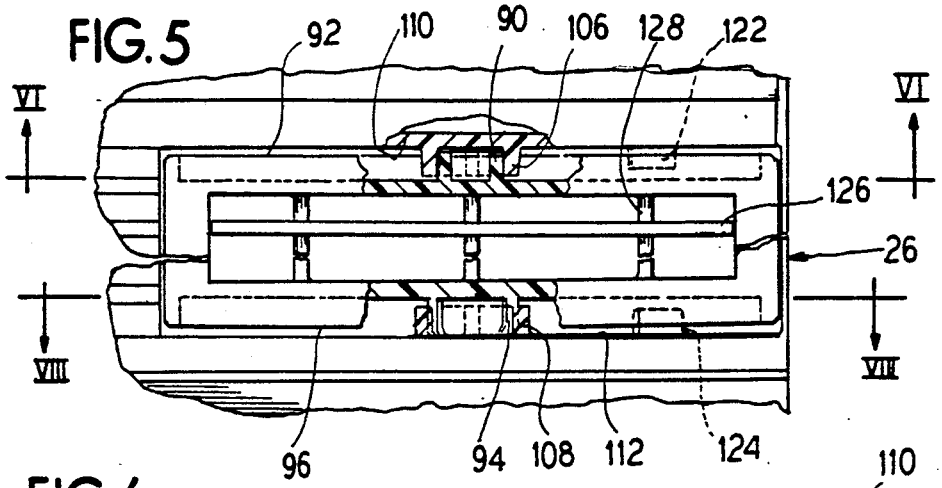
FIG. 5 is a partial sectional view of the air discharge module illustrating its attachment to the air conditioner.
Figure 6:
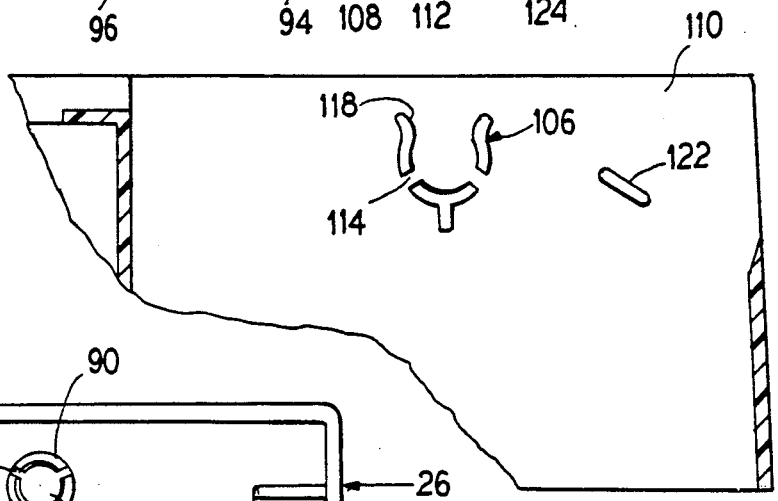
FIG. 6 is a partial sectional view of the air conditioner which the air discharge module removed taken generally along the line VI—VI of FIG. 5.

The internal components of the air conditioner are shown in greater detail in FIG. 3 and in this view the symmetrical nature of the air conditioner construction and symmetrical nature of the air flow is quite evident. Directly behind the front inlet grill 24 is located an evaporator 44 which is mounted within a sheet metal housing 46. The housing 46 has a central rear opening 48 which is positioned directly in front of an air moving device, preferably a blower wheel 50. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the air conditioner. Directly behind the fan blade is the condenser coil 60. A compressor 62 is provided as is known in the art.

The forwardly extending drive shaft 52 extends through an opening 64 in a barrier wall 66 provided between the blower wheel 50 and the motor 52. The barrier wall 66 separates the cold side of the air conditioner (forward of the wall) from the hot side (rearward of the wall). This is desireable to prevent air which has been chilled by passing through the evaporator 44 from being inadvertently discharged through the rear of the air conditioner and to prevent hot air in the condenser portion of the air conditioner from being inadvertently drawn into the cold portion of the air conditioner. A barrier of expanded polystyrene 68 is provided along the barrier wall 66 which provides an insulation against heat transfer. A preferred assembly method and construction of the air conditioner is described in greater detail in copending application Ser. No. 522180 entitled "Assembly Method and Construction for a Room Air Conditioner" which disclosure is incorporated herein by reference.

As the blower wheel 50 rotates, air is symmetrically drawn into an open center area 70 of the blower wheel 50 from through the opening 48 in the evaporator housing and is caused to leave the blower wheel with radial and tangential flow components. The central location of the opening 48 assures even flow of air through the evaporator coil which enhances the efficiency of heat transfer at the evaporator coil. The expanded polystyrene wall 68 includes forward projecting portions 72, 74 surrounding the blower wheel which form a pair of volute passages and which lead respectively to right and left lateral openings 80, 82. The volute passages and openings 80, 82 are configured and arranged so as to approximately evenly divide the air stream generated by the fan blower 50 and to direct each separate air stream exit through a separate opening. The expanded polystyrene wall is shown and described in greater detail in copending application Ser. No. 522179 entitled "Dual Side Discharge Room Air Conditioner with Foamed Insulation Air Passage Walls" which disclosure is incorporated herein by reference.

Adjacent and downstream of each opening 80, 82 is a transition air duct 84, 86 which is formed by a portion of the barrier wall 66 which is angled forwardly so as to redirect the air from the blower toward the front of the air conditioner. The opposite side of each of the transition air ducts is formed by a rear angled wall of the evaporator housing 46.

Figure 7:
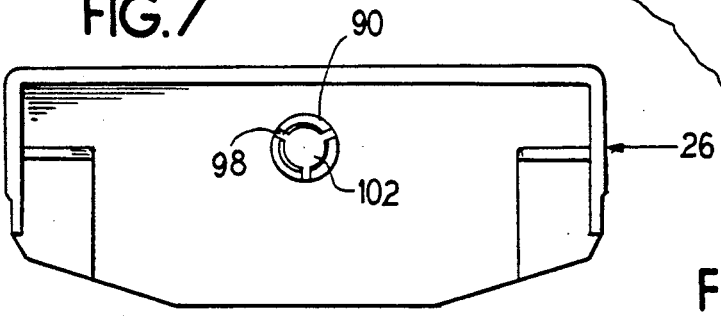
FIG. 7 is a top elevational view of the air discharge module.
Figure 8:
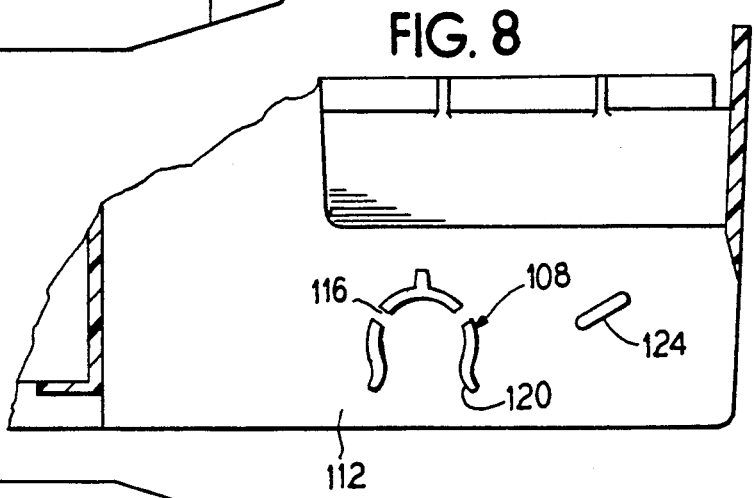
FIG. 8 is a partial sectional view of the air conditioner with the air discharge module removed, taken generally along the line VIII—VIII of FIG. 5.
Figure 9:
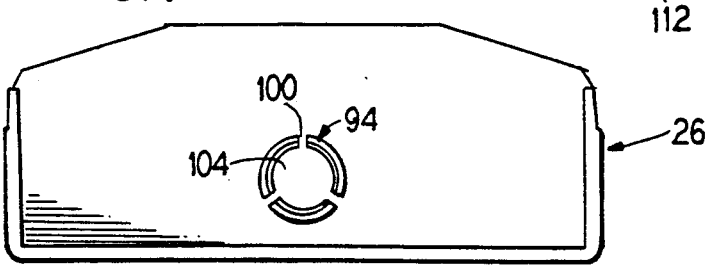
FIG. 9 is a bottom elevational view of the air discharge module.

Positioned at the front of the air conditioner in an outlet of each of the transition air ducts 84, 86 is the outlet modular unit 26 which is shown in greater detail in FIGS. 5-9. Each unit 26 comprises a box-like member having a vertically upwardly projecting pin 90 at a top end 92 and a vertically downwardly projecting pin 94 at a bottom end 96. The pins 90, 94 preferably are compressible and in a preferred arrangement as best seen in FIGS. 7 and 9, the pins 90, 94 include spaced relieved areas 98, 100 as well as a hollow interior 102, 104 which permit the pins 90, 94 to be compressible.

The pins 90, 94 are received in snap mount sockets 106, 108 which are formed in a top wall 110 and bottom wall 112 of the transition air ducts 84, 86. The sockets 106, 108 also are preferably resilient and may take the form of U-shaped sockets having relieved areas 114, 116 providing the resiliency of the socket. Further, at the open end of the U, the socket legs forming the U may be flared outwardly as at 118, 120 to provide entering guidance for the pins 90, 94. Thus, the modular unit 26 is easily inserted into the front opening of the transition air ducts 84, 86 and are readily held in place through the resilient interaction of the pins 90, 94 and sockets 106, 108.

By use of the pins and sockets, the units 26 are pivotable about a vertical axis defined by the pins 90, 94 thus permitting the units 26 to pivot through an angle $\alpha$ as shown in FIG. 3 which is approximately 30°. Stop members 122, 124 project from the top wall 110 and bottom wall 112 of the air ducts 86, 84 to provide a limit of outward angling of the modular units 26 as seen in FIG. 3.

The modular units 26 each have a plurality of horizontal louvers 126 as well as a plurality of vertical louvers 128. In a preferred embodiment, the vertical louvers 128 are fixed relative to the modular unit 26 and pivoting of the vertical louvers occurs by means of the pivoting of the unit about an axis of the pins 90, 94. Further, the horizontal louvers 126 preferably pivot independently of the modular unit 26. Each of the horizontal louvers 126 may pivot about its own pivot point, which is separate from the pivot point of other horizontal louvers, or two or more louvers may pivot about a common pivot point. It will be appreciated by those of ordinary skill in the art that the described arrangement can be reversed, that is the horizontal louvers may pivot with the unit by placing the pins on the sides of the unit such that the unit will pivot about a horizontal axis while making the vertical louvers 128 pivot independently of the unit. Further, it will be appreciated that the unit could be constructed with a single vertical pivot point and a single horizontal pivot point and a pair of nested boxes, one pivoted to the other with horizontal and vertical louvers held in a fixed relationship relative to the inner box. A most preferred arrangement is described in detail in co-pending application Ser. No. 522198 entitled "ADJUSTABLE LOUVER ASSEMBLY FOR A ROOM AIR CONDITIONER" which disclosure is incorporated herein by reference.

Figure 4:
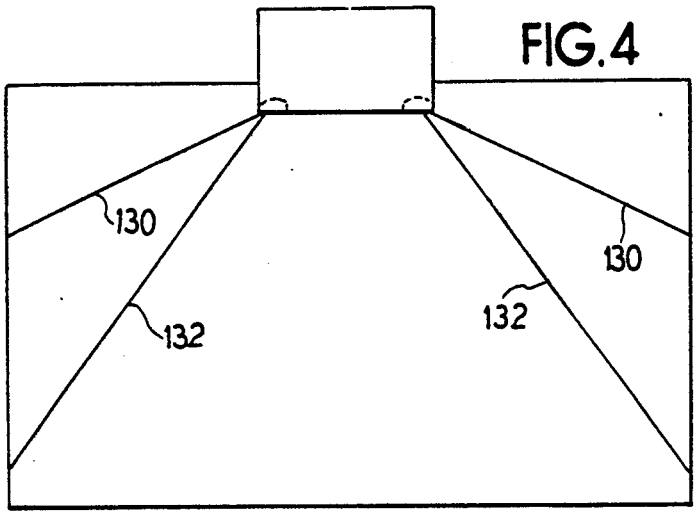
FIG. 4 is a schematic illustration of the air discharge pattern of an air conditioner embodying the principles of the present invention.

By having the modular units 26 positioned at each lateral side of the air conditioner, and since each of the modular units is permitted to angle outwardly, the horizontal angular range of directable air flow is expanded to lines 130 as shown in FIG. 4 which is greater than the range normally available as illustrated by lines 132. Thus, cool air can be directed over a wider horizontal range within the room which accelerates the sensed cooling within a room since there will be smaller "hot" pockets of air not directly in the air flow pattern generated by the air conditioner.

Thus, it is seen that the present invention provides an air conditioner that has a multiple air flow exit with horizontally and vertically directable air flow outlets at each exit. The air flow outlets have pivotable vertical and horizontal louvers and are preferably arranged in modular units which can easily be inserted and removed from the air conditioner. In a preferred embodiment the modular units are pivotably mounted in the air conditioner about a vertical axis and the horizontal louvers are pivotable about a horizontal axis.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner comprising:

an evaporator centered on a center line of and at a front side of said air conditioner;

an air moving device centered behind said evaporator coil for causing air to flow in a stream evenly through said evaporator;

a housing for said air moving device centered behind said evaporator coil having openings positioned on opposite sides of said air moving device for dividing said air stream into separate and substantially equal air streams;

separate air conduits being substantially equal in size and shape and being positioned symmetrically relative to said center line for directing said separate air streams toward separate air exit openings through at least one side of said air conditioner, said air exit openings being substantially equal in size and shape, said openings, air conduits and air exit openings defining means for evenly drawing air into said air conditioner, split into two relatively equal streams and directed out of said air conditioner in two streams of substantially equal air flow; and an air flow outlet at an open end of each air conduit having means therein for selectively and independently directing said air streams through a range of horizontal and vertical angles relative to said side of said air conditioner.

2. A room air conditioner according to claim 1, wherein said air flow outlet comprises a modular unit which is mounted in said air conditioner in a manner which permits it to be pivoted about a vertical axis.

3. A room air conditioner according to claim 2, wherein said modular unit includes horizontal and vertical louvers.

4. A room air conditioner according to claim 3, wherein said horizontal louvers are pivotable about at least one horizontal axis.

5. A room air conditioner according to claim 4, wherein said horizontal louvers are pivotable about a plurality of horizontal axes.

6. A room air conditioner according to claim 1, wherein said air streams are directable at each outlet through a horizontal range of approximately 30°.

7. A room air conditioner according to claim 2, wherein said modular unit has a vertical pin extending upwardly from a top wall thereof and a vertical pin extending from a bottom wall thereof, each of said pins being received in a socket in said air conduit.

8. A room air conditioner comprising:

an evaporator coil centered on a center line of and located at a front side of said air conditioner;

an air moving device centered behind said evaporator coil for causing air to flow in a stream through an inlet in a front side of said air conditioner and then through said evaporator coil;

a housing for said air moving device having a pair of openings positioned on opposite sides of said air moving device for dividing said air stream into two separate and substantially equal air streams;

two separate air conduits being substantially equal in size and shape and being positioned symmetrically relative to said center line for directing said separate air steams toward two separate air exit openings at said front side of said air conditioner on opposite sides of said inlet, said air exit openings being substantially equal in size and shape, said openings, air conduits and air exit openings defining means for evenly drawing air into said air conditioner, split into two relatively equal streams and directed out of said air conditioner in two streams of substantially equal air flow; and an air flow outlet at an open end of each air conduit having means therein for selectively and independently directing said air streams through a range of horizontal and vertical angles relative to said front side of said air conditioner.

9. A room air conditioner according to claim 8, wherein said air flow outlet comprises a modular unit which is mounted in said air conditioner in a manner which permits it to be pivoted about a vertical axis.

10. A room air conditioner according to claim 9, wherein said modular unit includes horizontal and vertical louvers.

11. A room air conditioner according to claim 10, wherein said horizontal louvers are pivotable about at least one horizontal axis.

12. A room air conditioner according to claim 11, wherein said horizontal louvers are pivotable about a plurality of horizontal axes.

13. A room air conditioner according to claim 8, wherein said air streams are directable at each outlet through a horizontal range of approximately 30°.

14. A room air conditioner according to claim 9, wherein said modular unit has a vertical pin extending upwardly from a top wall thereof and a vertical pin extending from a bottom wall thereof, each of said pins being received in a socket in said air conduit.

15. A room air conditioner comprising:

an evaporator coil centered on a center line of said air conditioner;

an air moving device for causing air to flow in a stream through an inlet in a front side of said air conditioner and then through said evaporator coil;

a housing for said air moving device having a pair of openings positioned on opposite sides of said air moving device for dividing said air stream into two separate and substantially equal air streams;

two separate air conduits being substantially equal in size and shape and being positioned symmetrically relative to said center line said openings and air conduits defining means for directing said separate and substantially equal air streams toward two separate air exit openings at said front side of said air conditioner on opposite sides of said inlet; and an air flow outlet at an open end of each air conduit comprising a modular unit including horizontal and vertical louvers, said vertical louvers being pivotable about at least one vertical axis and said horizontal louvers being pivotable about at least one horizontal axis.

16. A room air conditioner according to claim 15, wherein said horizontal louvers are pivotable about a plurality of horizontal axes.

17. A room air conditioner according to claim 15, wherein said air streams are directable at each outlet through a horizontal range of approximately 30°.

18. A room air conditioner according to claim 15, wherein said modular unit has a vertical pin extending upwardly from a top wall thereof and a vertical pin extending from a bottom wall thereof, each of said pins being received in a socket in said air conduit.

19. A room air conditioner according to claim 15, wherein said modular unit is pivotally held in said air conditioner in a releasable manner.

* * * * *